US010612769B2

(12) United States Patent
Agreste, Jr. et al.

(10) Patent No.: US 10,612,769 B2
(45) Date of Patent: Apr. 7, 2020

(54) ILLUMINATION PLAQUE FOR ACCENTUATING EFFECT OF AN ELECTRICAL DEVICE

(71) Applicants: Joseph A. Agreste, Jr., Chesapeake, VA (US); Joseph A. Agreste, III, Chesapeake, VA (US)

(72) Inventors: Joseph A. Agreste, Jr., Chesapeake, VA (US); Joseph A. Agreste, III, Chesapeake, VA (US)

( * ) Notice: Subject to any disclaimer, the term of this patent is extended or adjusted under 35 U.S.C. 154(b) by 0 days.

(21) Appl. No.: 15/703,158

(22) Filed: Sep. 13, 2017

(65) Prior Publication Data

US 2019/0078770 A1 Mar. 14, 2019

(51) Int. Cl.

| | |
|---|---|
| ***F21V 23/00*** | (2015.01) |
| ***F21V 33/00*** | (2006.01) |
| ***F21V 19/00*** | (2006.01) |
| ***F21V 7/00*** | (2006.01) |
| ***G07C 9/00*** | (2020.01) |
| *F21Y 115/10* | (2016.01) |
| *F21Y 105/18* | (2016.01) |
| *F21Y 103/33* | (2016.01) |

(52) U.S. Cl.

CPC ..... *F21V 33/006* (2013.01); *F21V 7/0091* (2013.01); *F21V 19/003* (2013.01); *F21V 23/002* (2013.01); *F21V 33/0052* (2013.01); *F21V 33/0076* (2013.01); *G07C 9/00007* (2013.01); *F21Y 2103/33* (2016.08); *F21Y 2105/18* (2016.08); *F21Y 2115/10* (2016.08)

(58) Field of Classification Search

CPC ..... F21V 11/06; F21V 13/00; F21V 17/00; F21V 19/00; F21V 7/0091; F21V 19/003; F21V 33/006; F21V 23/002; F21Y 2105/18

See application file for complete search history.

(56) References Cited

U.S. PATENT DOCUMENTS

| | | | | |
|---|---|---|---|---|
| 7,925,223 | B2 | 4/2011 | Raggam | |
| 9,218,823 | B2 | 12/2015 | Kief | |
| 2011/0194282 | A1* | 8/2011 | Paik | F21V 5/007 362/245 |
| 2014/0226361 | A1* | 8/2014 | Vasylyev | F21V 7/0091 362/606 |
| 2015/0076231 | A1 | 3/2015 | Buccola | |
| 2016/0110639 | A1 | 4/2016 | Finn et al. | |
| 2016/0181695 | A1 | 6/2016 | Mukherjee | |

* cited by examiner

*Primary Examiner* — Thien M Le
*Assistant Examiner* — April A Taylor
(74) *Attorney, Agent, or Firm* — William G. Sykes

(57) ABSTRACT

An illumination device for projecting light laterally from an appliance along a surface on which the appliance is mounted. The illumination device includes a slab of light transmissive material having internal reflectance characteristics, a lighting element within the slab, and power conductors connected to the lighting element and projecting from the slab. The power conductors may be series connected to an energizable circuit of the appliance and mounted on an environmental surface formerly bearing the appliance. When so connected, the slab will illuminate when the appliance circuit is energized, and will project light along the environmental surface, thereby supplementing light emitted by the appliance, or accentuating the appliance by supplemental light.

13 Claims, 2 Drawing Sheets

ILLUMINATION PLAQUE FOR ACCENTUATING EFFECT OF AN ELECTRICAL DEVICE

RELATED APPLICATIONS

This application claims priority in accordance with 37 CF.R. § 1.19(e) to U.S. Provisional Patent Application Ser. No. 62/440,603 filed for ILLUMINATION PLAQUE FOR ACCENTUATING EFFECT OF AN ELECTRICAL DEVICE filed Dec. 30, 2016 which is included herein in its entirety by reference.

FIELD OF THE DISCLOSURE

The present disclosure relates to utilitarian electrical devices, and more particularly, to an illuminated plaque for enhancing perceived performance of a utilitarian electrical device associated with the plague.

BACKGROUND

In electrical devices such as proximity card readers, automatically actuated security cameras, and security lighting fixtures, it is desirable to communicate with people in the vicinity. In the case of a proximity card reader, which may have exposed light emitting diodes (hereinafter, LEDs) for signaling status upon reading a card, it may be desirable to accentuate the effect of the LED. In a security camera, it may be desirable to signal to people in the vicinity that the security camera is present and operating. Many security cameras are announced by a sign. However, the sign is a passive device which must be discerned and heeded by people in the vicinity to be effective in deterring undesirable behaviors. In a security light, security lighting or illumination may be ineffectively focused or propagated due to for example reliance upon conventional light bulbs. In a control device for a building, such as a wall mounted thermostat, additional lighting may render the control device more conspicuous. Each of these devices may have enhanced performance if lighting features can be more effectively directed and propagated.

It is desirable to provide enhanced lighting without extensive redesign, complication, and cost of the host electrical device.

There remains a need for an illuminating device which extends effectiveness of a host electrical device through more advantageous projection of light.

SUMMARY

The disclosed concepts address the above stated situation by providing a light source which propagates light laterally relative to the direction of light conventionally emitted from an electrical device. To this end, an illumination plaque may comprise a slab containing LED lights. The slab has considerable internal reflectance, so that light emitted by the LEDs is conducted along the length of the slab, and is visible from edges of the slab. The slab has openings for passing electrical power and signal conductors of the host electrical device, and optionally, additional openings for receiving or passing fasteners. Electrical circuitry of the illumination plague may include a pigtail, an informal term referring to shielded electrical conductors, projecting from the plaque, for connection to the electric system of the host electrical device. The pigtail may be connected to circuitry of the host electrical device which powers indicating lights on the host device. Therefore, when the indicating lights of the host device illuminate, the LEDs carried on the illumination plaque will also illuminate. Light from the illumination plaque is conducted to lateral edges of the illumination plague, and propagates laterally relative to the direction of light emission from the indicating lights of the host electrical device. This greatly enhances the effect of the indicating lights of the host device.

In the case of a proximity card reader, the illumination plaque may be fabricated from an electrically non-conductive material. The illumination plaque then performs additional duty as a non-conductive spacer spacing the sensing portion of the proximity card reader from circuitry housed typically within a metallic housing. This feature overcomes interference with sensing or reading cards, which may arise from the metallic housing. Consequently, the illumination plaque not only amplifies signal lighting, but also extends the range of effectiveness of the sensing portion. Consequently, cards may be successfully read at a greater distance from the card reader than would be the case in the absence of the illumination plaque.

For security lighting fixtures, which may be focused forwardly, light may be projected laterally, thereby increasing security illumination.

A wall mounted control such as a thermostat, switch, or lock may be identified as to location in a dark environment by incorporation of the novel illumination plaque.

It is an object to provide improved elements and arrangements thereof by apparatus for the purposes described which is inexpensive, dependable, and fully effective in accomplishing its intended purposes.

These and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
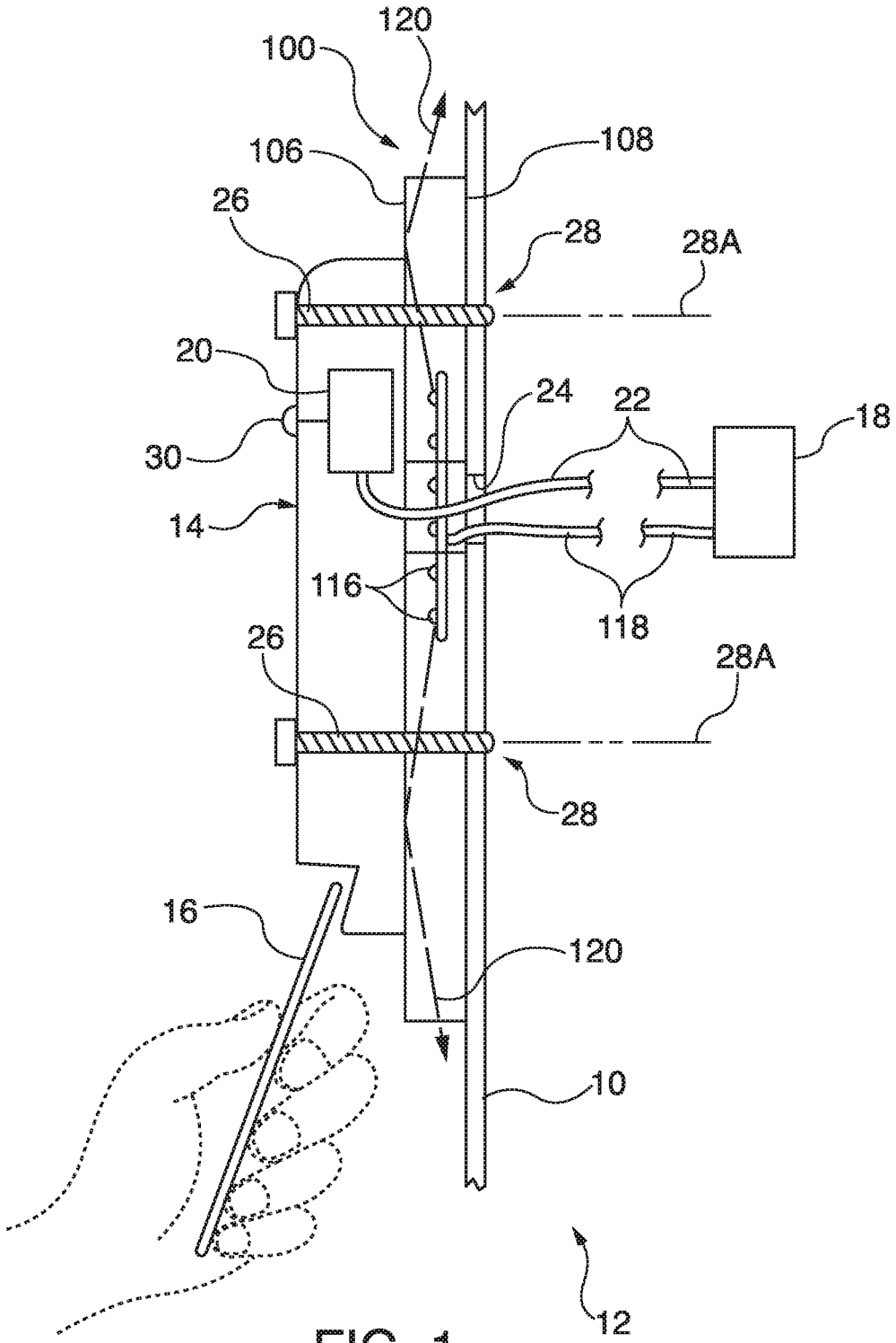
FIG. 1 is a diagrammatic environmental side cross sectional view of an illumination plaque, according to at least one aspect of the disclosure.

Referring first to FIG. 1, according to at least one aspect of the disclosure, there is shown a representative application for an illumination plaque 100. Illumination plaque 100 is mounted to an environmental surface such as a sheet metal, wall 10 of a cabinet (not shown in its entirety) devoted to a security system incorporating an electronic proximity card reader 12. In FIG. 1, electronic proximity card reader 12 is not shown in its entirety. Rather, FIG. 1 shows only a scanning head 14 which receives a card 16, and remote electronics 18. Remote electronics 18 may comprise for example an interface with a controlled access portal (not shown). An electrical circuit 20 communicates with other components of electronic proximity card reader 12 via power conductor 22. Although only one power conductor 22 is depicted in FIG. 1, it will be understood that power conductor 22 will include as many individual conductors as necessary for operability of electronic proximity card reader 12.

Sheet metal wall 10 may include an opening 24 for passing electrical conductors such as power conductor 22. Ordinarily, scanning head 14 may be mounted on sheet metal wall 10 using fasteners such as bolts 26. Bolts 26 pass through scanning head 14 and engage holes 28 in sheet metal wall 10. In conventional practice, bolts 26 may be of the security type which are not engageable by ordinary tools.

The security system of which scanning head 14 is part has been improved by incorporation of illumination plaque 100 for enhancing illumination from an electrical device (e.g., the security system including scanning head 14) having illumination light(s) 30 projecting light forwardly from the electrical device. Another important benefit of illumination plaque 100 is that when illumination plaque 100 is interposed between scanning head 14 and sheet metal wall 10 typical of most card reader installations, scanning head 14 becomes operable at greater distances from card 16, as illumination plaque 100 is fabricated from an electrically non-conductive material.

Figure 2:
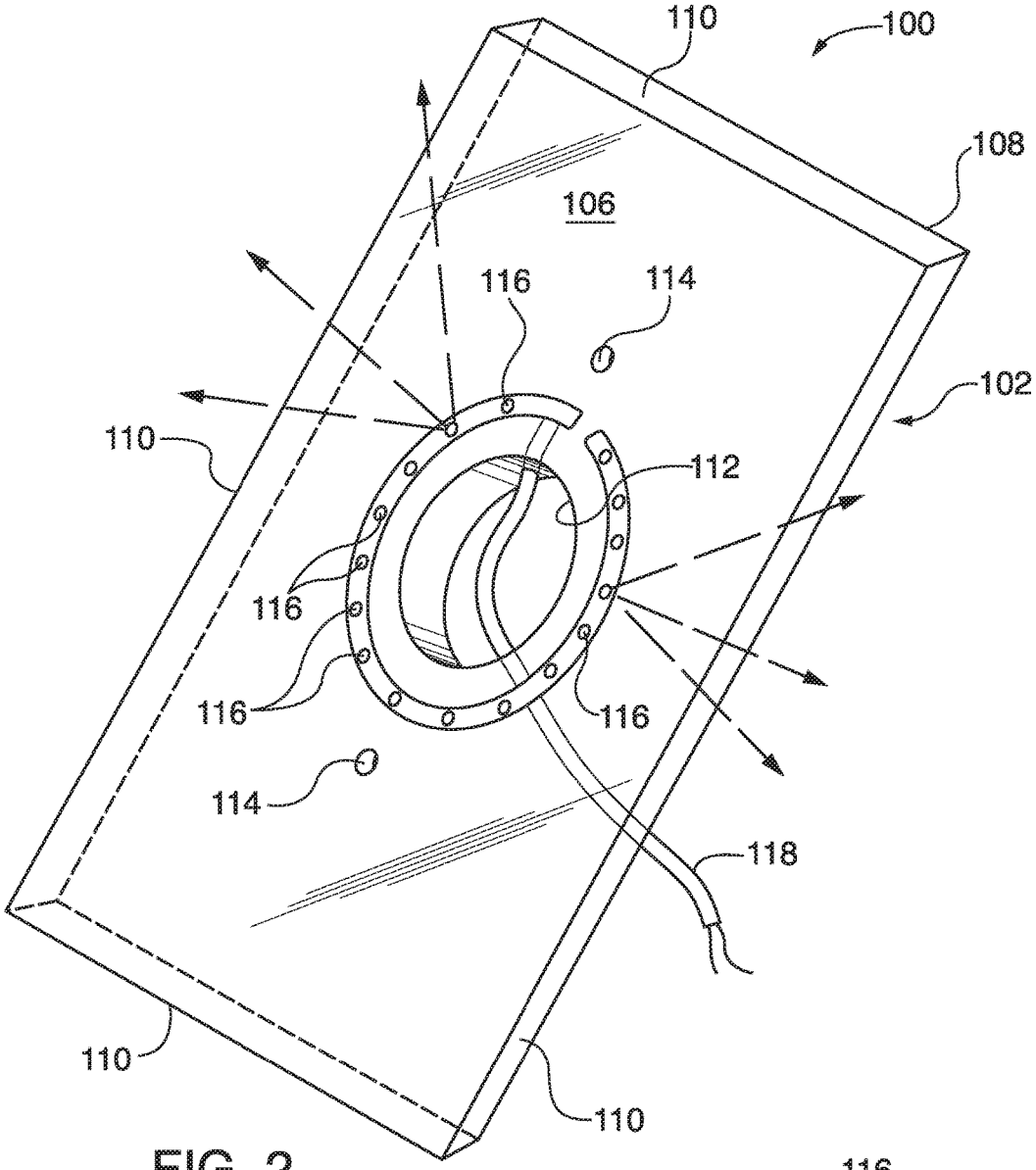
FIG. 2 is a diagrammatic front perspective view of an illumination plaque, according to at least one aspect of the disclosure.

Referring also to FIG. 2, illumination plaque 100 may comprise a light transmissive slab 102 of material having internal reflectance from external surfaces (e.g., 106, 108) of slab 102. Slab 102 may include an obverse face 106, an opposed reverse face 108, a peripheral edge 110 extending from obverse face 106 to opposed reverse face 108, a central opening 112 extending from obverse face 106 to opposed reverse face 108, and at least one fastener opening 114 smaller than central opening 112. Illumination plaque 100 may comprise an array of light emitting elements 116 within slab 102 entirely between obverse face 106 and opposed reverse face 108, and power conductors 118 connected to light emitting elements 116. Power conductors 118 may project from and are accessible from reverse face 108 of slab 102. As seen in FIG. 1, power conductors 118 are between obverse face 106 and opposed reverse face 108, emerge from the slab only into central opening 112, and project towards reverse face 108 of slab 102. Power conductors 118 can then be routed to suitable terminals (not shown) or another appropriate portion of remote electronics 18, without requiring additional holes or passages to be formed in slab 102 or in sheet metal wall 10. In many cases, it will be desirable to connect power conductors 118 in parallel with power conductors serving illumination light(s) 30. Such connection will cause light to project laterally from illumination plague 100 as well as forwardly from scanner head 14.

The array of light emitting elements 116 may comprise a flexible strip of light emitting diodes (LEDs) mounted on a flexible substrate 130 (FIG. 3) containing power conductors (not individually shown) serving each individual LED, for example. These are available as commercial products and need not be further detailed herein.

Referring specifically to FIG. 2, the array of light emitting elements 116 may surround central opening 112. Further, the array of light emitting elements 116 may form a closed loop entirely surrounding central opening 112, whereby light is propagated in all lateral directions from slab 102 when light emitting elements 116 are illuminated. Lateral projection of light through slab 102, including internal reflectance, is indicated by arrows 120 in FIG. 1. Surrounding central opening 112 with light emitting elements 116 causes illumination to be projected from all facets of peripheral edge 110 of slab 102. Locating individual light emitting elements 116 as a closed loop causes peripheral light to be uniformly emitted along the full extent of peripheral edge 110 of slab 102.

Slab 102 may be fabricated from poly(methyl methacrylate), also known by the IUPAC name of poly(methyl 2-methylpropenoate), popularly abbreviated as PMMA, as well as acrylic plastic or acrylic glass, and by the trade names Plexiglas, Acrylite, Lucite, and Perspex.

Figure 3:
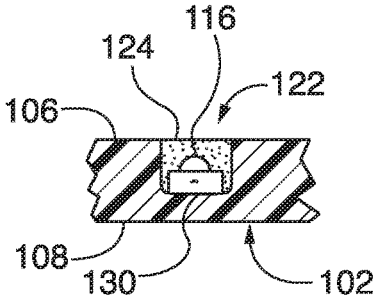
FIG. 3 is a cross sectional detail view taken from FIG. 3.

Referring also to FIG. 3, in one example of construction, slab 102 may comprise a channel 122 projecting into at least one of obverse face 106 and opposing reverse face 108, with light emitting elements 116 occupying channel 122. Illumination plague 100 may further comprise a material 124 potting light emitting elements 116 within channel 122. The potting material 124 may comprise silicone sealant, an adhesive, or any other translucent or transparent substance which would not damage slab 102 or the array of light emitting elements 116.

Channel 122 may be impinge on only obverse face 106 as shown in FIG. 3, or alternatively, may impinge on reverse face 108, or in still another alternative, may impinge in one or more places on obverse face 106 and in one or more places on reverse face 108.

As seen in FIG. 2, at least one fastener opening(s) may comprise a first fastener opening 114 on one side of central opening 112 and a second fastener opening 114 on an opposed side of central opening 112. This may match the bolt pattern of scanning head 14, thereby not requiring additional fasteners, and also stably pins slab 102 in place when illumination plaque 100 and scanning head 14 are assembled.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

In some realizations of illumination plaque 100, obverse face 106 and opposed reverse face 108 of slab 102 are rectangular, and peripheral edge 110 is perpendicular to obverse face 106 and reverse face 108. This arrangement maximizes distance of projection of light from slab 102.

The invention may be thought of as a method of projecting light laterally from an appliance (e.g., scanner head 14) including a voltage source, wherein the appliance is mounted to an environmental surface (e.g., sheet metal wall 10). The method may comprise interposing between the environmental surface and the appliance a light transmissive slab 102 of material having internal reflectance from external surfaces of slab 102, wherein slab 102 includes obverse face 106, opposed reverse face 108, peripheral edge 110 extending from obverse face 106 to opposed reverse face 108, central opening 112 extending from obverse face 106 to opposed reverse face 108, an electrically powered illumination element 116 within slab 102, and electrical supply circuit conductors 118 connected to the illumination element 116 and extending from slab 102, such that slab 102 is parallel to the environmental surface. The method may also comprise connecting electrical supply circuit conductors 118 to the voltage source (e.g., terminals in remote electronics 18, FIG. 1) of the appliance, whereby when the voltage source of the appliance is energized, illumination element 116 will illuminate, and light will propagate through slab 102 and be emitted mostly from peripheral edge 110 of slab 102. A small amount of light may be lost to imperfect internal reflectance of slab 102, projected ineffectively against a portion of the the appliance (such as the rear surface of scanning head 14), for projected ineffectively to the rear of illumination element(s) 116.

The method may further comprise routing electrical supply conductors 22 of the appliance through central opening 112 of 102 slab from the appliance to support circuitry (e.g., remote electronics 18) for the appliance behind the environmental surface.

The method may further comprise providing at least one fastener hole 114 in addition to central hole 112 of slab 102 parallel to at least one fastener mounting axis 28A (FIG. 1) of the appliance, and mounting slab 102 to the environmental surface using the same fastener openings 28 provided by the manufacturer of the appliance.

The method is articularly useful in enhancing light projection from pre-existing commercial products not originally designed for lateral light projection. Notably, not only may the method be used with proximity card readers such as that described above, but may be used with exterior and interior building lights, especially security lighting having illumination heads projecting light only forwardly, and wall mounted controls such as thermostats, switches, and others. In the latter examples, devices not originally fitted with illumination lights such as illumination light 30 may be modified to provide a pilot light as well as enhanced lateral general illumination.

In this application, electrical devices will be understood to encompass appliances operating on either or both AC and DC current, and purely electrical devices such as resistance based incandescent lighting and other forms of lighting, electric solenoids and motors, and other devices, and also electronics, such as those utilizing electronic circuitry incorporating semiconductors such as transistors.

While the disclosed concepts have been described in connection with what is considered the most practical and preferred implementation, it is to be understood that the disclosed concepts are not to be limited to the disclosed arrangements, but are intended to cover various arrangements which are included within the spirit and scope of the broadest possible interpretation of the appended claims so as to encompass all modifications and equivalent arrangements which are possible.

We claim:

1. An illumination plaque for enhancing illumination from an electrical device having illumination lights projecting light forwardly from the electrical device, the illumination plaque comprising:

a light transmissive slab of material having internal reflectance from external surfaces of the light transmissive slab, the light transmissive slab including an obverse face, an opposed reverse face, a peripheral edge extending from the obverse face to the opposed reverse face, a central opening extending from the obverse face to the opposed reverse face, and at least one fastener opening smaller than the central opening; and an array of light emitting elements within the light transmissive slab entirely between the obverse face and the opposed reverse face, and power conductors connected to the light emitting elements, wherein the power project from and are accessible from the reverse face of the light transmissive slab.

2. The illumination plaque of claim 1, wherein the array of light emitting elements surrounds the central opening.

3. The illumination plaque of claim 2, wherein the array of light emitting elements forms a closed loop entirely surrounding the central opening, whereby light is propagated in all lateral directions from the light transmissive slab.

4. The illumination plaque of claim 2, wherein the power conductors are between the obverse face and the opposed reverse face and between the peripheral edge and the central opening, and the power conductors emerge from the light transmissive slab only into the central opening.

5. The illumination plaque of claim 4, further comprising a material potting the array of light emitting elements within the channel.

6. The illumination plague of claim 2, wherein the at least one fastener opening comprises a first fastener opening on one side of the central opening and a second fastener opening on an opposed side of the central opening.

7. The illumination plaque of claim 1, wherein the light transmissive slab comprises a channel projecting into at least one of the obverse face and the opposing reverse face, and the array of light emitting elements occupies the channel.

8. The illumination plaque of claim 1, wherein the obverse face and the opposed reverse face of the light transmissive slab are rectangular, and the periphery is perpendicular to the obverse face and the reverse face.

9. The illumination plaque of claim 1, wherein the light emitting elements comprise light emitting diodes.

10. The illumination plaque of claim 1, wherein the light transmissive slab comprises acrylic plastic.

11. A method of projecting light laterally from an appliance including a voltage source, wherein the appliance is mounted to an environmental surface, the method comprising:

interposing between the environmental surface and the appliance a light transmissive slab of material having internal reflectance from external surfaces of the light transmissive slab, wherein the light transmissive slab includes an obverse face, an opposed reverse face, a peripheral edge extending from the obverse face to the opposed reverse face, a central opening extending from the obverse face to the opposed reverse face, an electrically powered illumination element within the light transmissive slab, and electrical supply circuit conductors connected to the illumination element and extending from the light transmissive slab, such that the light transmissive slab is parallel to the environmental surface; and connecting the electrical supply circuit conductors to the Voltage source of the appliance, whereby when the voltage source of the appliance is energized, the illumination element will illuminate, and light will propagate through the light transmissive slab and be emitted from the peripheral edge of the slab apart from a small amount of light which may be lost to imperfect internal reflectance of the light transmissive slab, projected ineffectively against a portion of the appliance, or projected ineffectively to the rear of illumination elements.

12. The method of claim 11, further comprising routing electrical supply conductors of the appliance through the central opening of the light transmissive slab from the appliance to support circuitry for the appliance behind the environmental surface.

13. The method of claim 11, further comprising:

providing at least one fastener hole in addition to the central hole of the light transmissive slab parallel to at least one fastener mounting axis of the appliance; and mounting the light transmissive slab to the environmental surface using the same fastener openings provided by a manufacturer of the appliance.

* * * * *